US009269249B2

(12) United States Patent
Amis

(10) Patent No.: US 9,269,249 B2
(45) Date of Patent: Feb. 23, 2016

(54) SYSTEMS AND METHODS UTILIZING VARIABLE TEMPO SENSORY OVERLOAD TO DETER, DELAY, DISTRACT OR DISRUPT A PERPETRATOR AND DECREASE AN INTENSITY OF A POTENTIAL CRIMINAL ACT

(71) Applicant: David Amis, Durango, CO (US)

(72) Inventor: David Amis, Durango, CO (US)

( * ) Notice: Subject to any disclaimer, the term of this patent is extended or adjusted under 35 U.S.C. 154(b) by 70 days.

(21) Appl. No.: 13/661,172

(22) Filed: Oct. 26, 2012

(65) Prior Publication Data

US 2014/0118144 A1 May 1, 2014

(51) Int. Cl.
*G08B 21/00* (2006.01)
*G08B 21/02* (2006.01)

(52) U.S. Cl.
CPC ..... *G08B 21/02* (2013.01)

(58) Field of Classification Search
None
See application file for complete search history.

(56) References Cited

U.S. PATENT DOCUMENTS 6,084,516 A * 7/2000 Yasushi ..... A61B 5/0002 340/4.14
6,204,762 B1 * 3/2001 Dering ..... F41H 13/0043 340/384.3
6,288,644 B1 * 9/2001 Mathews ..... G08B 13/18 250/559.45
7,474,208 B1 * 1/2009 Klein ..... G08B 21/24 340/384.4
2002/0180594 A1 * 12/2002 Flick ..... B60R 25/104 340/426.1
2004/0130439 A1 * 7/2004 Stouffer ..... B60R 25/104 340/425.5
2004/0201491 A1 * 10/2004 Weng ..... G08C 17/02 340/12.29
2005/0040935 A1 * 2/2005 Ewert ..... B60Q 5/00 340/384.2
2005/0195092 A1 * 9/2005 Takahashi ..... G01C 21/26 340/692
2005/0219040 A1 * 10/2005 Dryer ..... 340/384.71
2005/0280513 A1 * 12/2005 McDaniel ..... G08B 3/10 340/384.71
2006/0139152 A1 * 6/2006 Keeler ..... B06B 1/0284 340/384.6
2007/0103276 A1 * 5/2007 Kousaka ..... G10K 9/13 340/388.1
2007/0103876 A1 * 5/2007 Huang ..... H04B 1/3816 361/737

* cited by examiner

*Primary Examiner* — Ojiako Nwugo

(57) ABSTRACT

The present invention builds on TASOS as well as recent discoveries in how the human brain manages multiple tasks and deals with new information or stimuli in order to impact a perpetrator's ability to complete a crime, deter, delay, disrupt and distract perpetrators of violent crimes. A sensory overload controller is used to initiate various audible and visual events to deliver sophisticated mental stimulation that challenge a perpetrator's ability to mentally focus and succeed at certain tasks.

8 Claims, 3 Drawing Sheets

SYSTEMS AND METHODS UTILIZING VARIABLE TEMPO SENSORY OVERLOAD TO DETER, DELAY, DISTRACT OR DISRUPT A PERPETRATOR AND DECREASE AN INTENSITY OF A POTENTIAL CRIMINAL ACT

CROSS-REFERENCE TO RELATED APPLICATIONS

The present application is a Continuation-in-Part of U.S. Non-Provisional patent application Ser. No. 13/348,566, filed on Jan. 11, 2012. The present application also claims the benefit of U.S. Provisional patent application No. 61/551,877, filed on Oct. 26, 2011, as well as the benefit of co-pending U.S. Non-Provisional patent application Ser. No. 12/862,117, filed on Aug. 24, 2010, which claims the benefit of U.S. Provisional patent application No. 61/236,265, filed on Aug. 24, 2009. The contents of each of the afore-mentioned patent applications are hereby incorporated by reference in their entireties.

BACKGROUND

1. Field of the Invention

The present invention relates generally to the field of safety management, and more specifically, expands on TASOS technologies and provides systems and methods to initiate various events which can disturb a perpetrator's thought process, thereby deterring, delaying, calming, and distracting perpetrators, and disrupting or decreasing the intensity of a potential criminal act, which are collectively coined TASOS II.

2. Description of Related Art

We are constantly reminded of the need for personal and home safety in today's society. The average person will be a victim of one or more crimes in their lifetimes. Meanwhile, significant constraints exist on the current criminal justice system as well as on private security companies to protect people. It follows that alternatives to traditional 911 emergency system responses would be beneficial.

Current personal safety solutions and services are aimed at protecting the user, and typically they do not focus on manipulating how a perpetrator operates except perhaps to play a loud siren or use strobe lights. Simple warnings or notices placed outside of homes and buildings, such as "Protected by ADT" may serve as a slight deterrent to some would-be criminals. Some more sophisticated security devices include motion sensors that simply turn on lights when movement is detected. However, many criminals are not persuaded by such warnings, and are willing to risk criminal prosecution in order to commit their crimes. Current deterrents do not effectively serve their purpose, as criminals still believe that they can control their environment and surrounding effectively to get away with a crime.

Current personal safety solutions do not proactively assess an environment or situation for a threat level, and then administer various events to that environment to confuse the perpetrator and make the perpetrator lose control of the situation. Therefore, there is a need for systems and methods that overcome the deficiencies of traditional safety solutions and services, and that serve to manipulate the thought process of a perpetrator in order to deter, distract or delay them, and thereby disrupt or decrease the intensity of a potential criminal act.

SUMMARY

In order for a human being to complete a task, such as shooting a gun, punching a victim, building a card house, etc., scientific studies have shown that they must go through a process called the OODA Loop (for observe, orient, decide, and act). In other words, they must observe something, orient themselves to it, and make a decision and then act. Put another way, a human being needs to perceive a situation, analyze or think about it, decide what to do and then do it.

In an embodiment, the present invention interferes with this requirement of a human being by bringing new information, new choices, unexpected events and more to deter, delay, and distract perpetrators, and disrupt or decrease the intensity of a potential criminal act.

In an embodiment, the present invention uses information related to the perpetrator and user's environment, as well as personal information about the perpetrator and the user, to determine various events, termed sensory overload events herein, to re-orient or interfere with the focus of the perpetrator from committing a crime to trying to figure out what is going on in the environment around them. One goal of such activity is to create a "Safety Window" which creates an amount of time from milli-seconds to minutes or hours that gives the user the opportunity to fight back, escape, think, gain some confidence, plan, and/or call for help, etc., as the perpetrator is no longer fully focused on the user, nor is the perpetrator in complete control of his or her environment. A "Safety Window" as described by Lamb and Amis is a period of time within a violent or threatened violent attack during which a person, electronic system or other means creates an opportunity for a person to improve their situation. For example, an attacker begins punching a user who has initiated a personal safety device response which begins playing the song "Bad Boys Bad Boys . . . whatcha gonna do . . . .", the attacker/perpetrator stops to wonder how this particular song has been chosen and what's causing it to play. The perpetrator stops or relents momentarily, thus giving the victim a moment in time to think, act, plan, etc.

In an embodiment, the present invention provides method for interfering with a thought process of a perpetrator, the method comprising: emitting, from a speaker, at least one audible sound; repeating, by a security controller, the audible sound based on a time duration; and adjusting, by the security controller, the time duration in order to change a tempo of the audible sound repetition. Interfering with the thought process of the perpetrator can lead to a variety of positive outcomes for the user including convincing the perpetrator to cease the criminal act, not begin it at all, decrease (intentionally or unintentionally) the level of violence, and/or create a safety window.

In another embodiment, the present invention provides a method for interfering with a though process of a perpetrator, the method comprising: outputting, from an electronic device, at least one visual event; repeating, by a security controller, the visual event based on a time duration; and adjusting, by the security controller, the time duration in order to change a tempo of the visual event repetition.

In yet another embodiment, the prevent invention provides a system for manipulating delivery of sensory events, the system comprising: a security controller configured to emit a control signal continuously or intermittently based on a time interval; and an electronic appliance coupled to the security controller, the electronic appliance configured to receive the control signal from the security controller continuously or intermittently based on the time interval, the electronic appliance further configured to activate or deactivate upon receipt of the control signal, and wherein the security controller is configured to adjust the time interval in order to change a tempo of the control signal transmission.

The systems and methods described herein are coined TASOS II, which contains five embodiments that could be used independently or in conjunction with one another. The five elements of TASOS II are:

a. Subconscious Stimulus Provider (SSP or "Neuron Jammer"): Modifying the tempo, speed, intervals, etc. of stimulus delivery to create an additional sensory experience and/or input data point. Increasing the speed for example of the sensory events, will cause a perpetrator's brain to subconsciously or consciously feel that there is "something going on"—something which needs to be figured out. Alternatively, it just creates a sense of foreboding.

b. Crime Focus Distracter (CFD or "Focus Splitter"): Creating additional goals/issues/tasks for the perpetrator, because with two goals/issues/tasks there is some deterioration of ability to execute tasks, however, at three goals/issues/tasks there is rapid deterioration of ability or even an inability to manage all three simultaneously or concurrently.

c. Counter Threat Creator (CTC or "Boogey Man 2"): Creating new threats, both real and perceived, which, when delivered correctly, will cause the brain of a human being to respond in some manner, such as giving mental attention, looking, listening, or in the best case, creating a whole stream of thoughts regarding that new threat. For example, a series of red flashing lights in sync with a voice that says, "Emergency robot responding . . ." creates a potential new threat. Even if the perpetrator does not believe there is such a thing as an emergency robot, his mind will devote some of its attention to address that question and to further ask "what does this mean? . . . is this a threat . . . if so, what kind? . . . what shall I do about it?".

d. Memory Stimulator (MStem or "Neuron Crowder"): Providing stimuli such as phrases, sounds, lights or others that cause a perpetrator to have a "memory event". For example, a jailhouse phrase such as "I hate the food at county" would cause the perpetrator to stop and recollect their experience or any memories they have concerning the quality of food at the county jail, where the majority of criminals go for a processing prior to a trial. By providing stimuli that activates a memory, a perpetrator's brain will automatically devote time and energy processing that memory and thus create some delay or possible reduction in their criminal activity. A "memory event" as used in this document, means the recall of a memory by a human being, which may or may not be voluntary and which will furthermore take time and energy, albeit in small amounts, away from the perpetrator's current focus. It may also lead to other memories, dilemmas, or issues that can impact behavior in a variety of ways.

e. Positive Behavior Modifier (PBM or "Carrot" or "Carrot and Stick"): By providing both positive and negative reinforcement, a perpetrator's behavior can be redirected to a positive outcome. For example, playing on a loudspeaker "the penalty for most felonies is five years . . . " or "isn't freedom great? You can't go to the mall when you're in lockup" or alternatively, providing soothing music or positive affirmations can remind a perpetrator that there are other better things to do which will have positive outcomes such as continued freedom, time with family, good food, etc.

f. In addition, maximizing false positives (referred to as Type II errors in the police world), in the mind of the perpetrator is also a goal of TASOS II. For example, supporting the belief that help is just about to arrive when in fact it may be far away or not coming at all. By providing information through a speaker phone, for example, or projecting an image on a mobile device screen such as "Mary, father is nearby, just hold on . . . " can create, promote, or support the perpetrator making a wrong conclusion about threats and other elements that may reduce his interest in completing the criminal act. A countdown with the words, "arrival in xxx seconds . . . " might convince a perpetrator that something is about to happen. There are subtler ways to do achieve this as well, such as a father's voice saying, "Are you there? Can you hear me"—which would indicate a father is looking for the victim and thus there is the potential of his arrival, but no definite arrival time or other constraint is provided that the perpetrator could use to assess the validity of the threat.

BRIEF DESCRIPTION OF THE DRAWINGS

These and other embodiments of the disclosure will be discussed with reference to the following exemplary and non-limiting illustrations, in which like elements are numbered similarly, and where.

DETAILED DESCRIPTION

Figure 1:
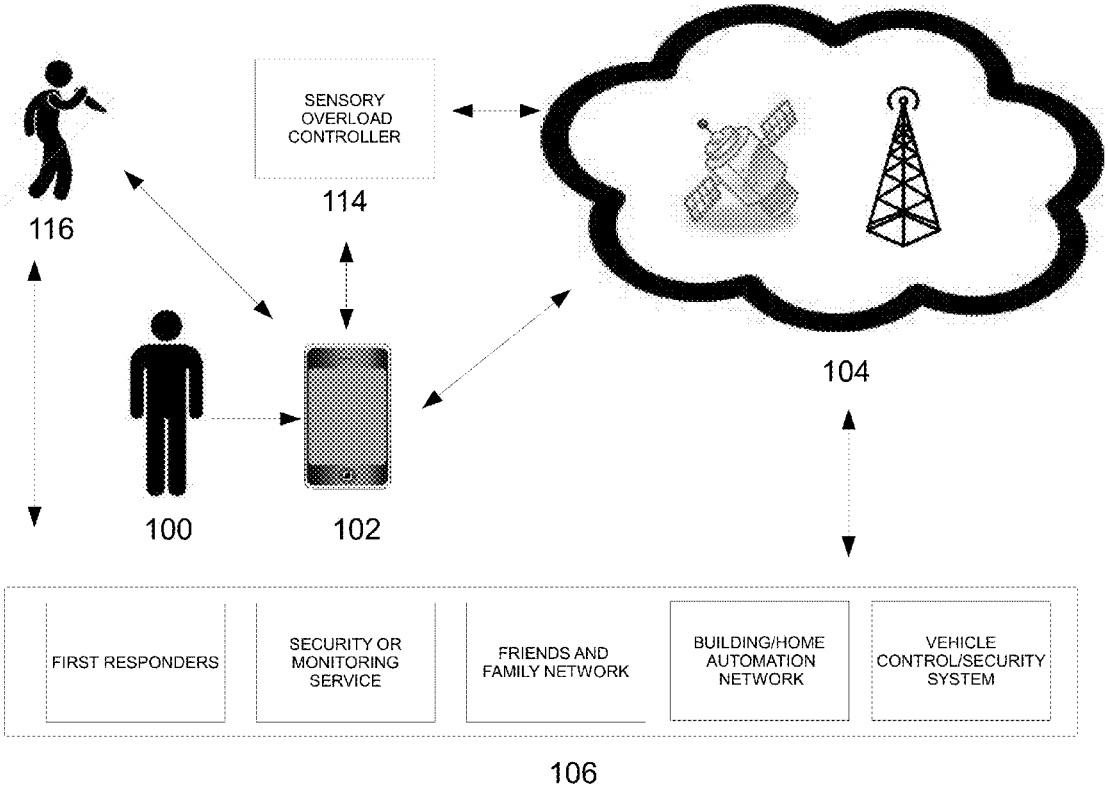
FIG. 1 is a block diagram of a security network in accordance with an embodiment of the present invention.

The various events discussed below are described in more detail in co-pending U.S. Non-Provisional patent application Ser. No. 12/862,117, filed on Aug. 24, 2010. These events are described herein as Sensory Events, and they can be selectively requested or triggered by the present invention in a particular situation, in order to distract, delay, and/or deter a perpetrator, and in order to disrupt or decrease the intensity of a crime or violent act.

This invention is based in part on the OODA Loop, a concept originally applied to law enforcement and combat operations, and which was originally developed by military strategist and United States Air Force Colonel John Boyd. The invention is also based in part on the Defense-in-Delay system, developed by David Amis and Brad Lamb of Strider Lab, which is based on the principle that anything used to delay a potential crime or perpetrator works to the victim's advantage. The present invention applies OODA Loop concepts to its processes, by observing and reacting to unfolding threatening events more rapidly than potential perpetrators, thereby disorienting, dazing, and confusing perpetrators before they act, or before they cause additional harm. The invention provides actions and reactions, some of which may be automatic, while others may be based on specific actions of a user, perpetrator, or a third-party. The invention further interferes with a potential perpetrator's OODA Loop, while also changing/adding goals and directives in a potential perpetrator's mind.

This invention is further based on the following concepts and recent discoveries:

1. That human frontal lobe function is limited to accurately driving two concurrent goals and that attempting a third goal either removes one of the former or causes rapid deterioration in effectiveness. This notion is described in *Divided Representation of Concurrent Goals in the Human Frontal Lobes*, Science 16: April 2010, vol 328 no. 5976, pp 360-360 and also referred to in several interviews such as Brain Splits to Multi-Tasks by Helen Briggs at the BBC, describing an interview with Dr. Etienne Koechlin, 15 Apr. 2010. This concept is further described by Dr.'s Honig and Lewinski (see below for more detail); highly trained police officers as well as normal people are not able to "perceive two elements of equally high significance at the same time". TASOS II takes advantage of this concept by either creating new goals in the mind of the perpetrator such as "I should figure out what that new piece of information means . . . " or disrupting other current goals such as "steal that purse".

2. That the front polar cortex (FPC) forms the apex of the "executive system underlying decision making" and that it is limited significantly to two "concurrent behavioral plans or mental tasks". This is described in *Anterior Prefrontal Function and the Limits of Human Decision-Making* by Etienne Koechlin and Alexandre Hyafi in Science 26 October 2007, vol 318, no. 5850 pp. 594-598. With an emphasis on "task" for our purposes, TASOS II creates additional tasks for the perpetrator's brain on both a conscious and subconscious level. For example, by altering the tempo or frequency of a particular stimuli such as a three 3-Element Stimuli Chains in progression, the perpetrator's brain will, on a subconscious level, realize "there is something going on"; something to which he or she may need to pay attention. In this way, TASOS II creates one or more additional mental tasks for the perpetrator.

Note: A "Stimuli Chain" as described by Strider Labs, is a series of stimuli, with a minimum of three, such as three distinct audible sounds, or three separate stimuli such as a light flashing, a voice saying "911 is coming" and a dog barking, which are intentionally delivered together and represent individually or as a group or even by their order, a new experience or data point for the perpetrator so that their natural reaction will be to address this new stimuli with mental attention such as asking themselves, "What does that mean?". Three stimuli are provided as an exemplary embodiment, however, two stimuli, or even a single stimuli, can be used in conjunction with the present invention.

3. That new threats create essentially automatic responses in a human being regardless of the severity of their attention control. As described in *Threat Prompts Defensive Brain Reponses Independently of Attention Control*, by Swann Pichon, Beatrice de Gelder, and Julie Grezes in Oxford Journals, Cerebral Cortex, Vol. 22, Issue 2, pp 274-285. TASOS II creates new overt and covert threats which are interpreted consciously or subconsciously by the perpetrator and lead to defensive responses mentally, emotionally, or that may result in physical action such as running away or cancelling an attack at the last minute. The important element here is that a human being cannot control their own thinking (i.e stay focused) when a new threat presents itself.

4. That "Type I" and "Type II" errors, as describe by Dr. Audrey Honig and Dr. William Lewinski in *A Survey of the Research on Human Factors Related to Lethal Force Encounters: Implications for Law Enforcement Training, Tactics and Testimony*, can be created and supported in the mind of a perpetrator. Type I errors are false negative whereas Type II errors are false positives. One goal of TASOS II technology is to maximize false positives in the mind of the perpetrator. In other words, create stimuli that lead the perpetrator to conclude that there are powerful reasons for stopping or withdrawing from a criminal encounter. These reasons only need to exist in the mind of the perpetrator, not necessarily in reality. By playing a countdown, for example, and by further increasing the tempo of that countdown, a perpetrator may conclude that something is about to happen which is important and possibly detrimental to his success, physical safety, or freedom (e.g. the police are coming).

5. That the presentation of new information may stimulate a human's memory and thus cause a recognition or comparison to that memory. As Honig and Lewinski describe (in the paper mentioned above) "the mere presentation of the relevant information may itself stimulate the memory trace . . . " Memories often hold emotions and information that that will affect an individual's thought processes. TASOS II takes advantage of this by utilizing stimuli or stimuli chains that will engender flight, quit, give up, or other behaviors in a perpetrator. For example, by playing commands on a mobile device loudspeaker commonly heard in a jail or law enforcement setting such as "Lockdown!", "Do you really want to go down for this?", or "Remember how bad the food is at county?", a perpetrator (assuming that most criminals are repeat offenders) will recall their incarceration experience and (a) be further distracted, (b) feel the emotion that they associate with that experience, and (c) experience other thoughts and concerns that relate to that experience, such as not wanting to go back there.

In this way, Memory Stimulator again disrupts their thinking but also provides a potential positive stimuli to flee the scene and terminate any criminal activity. Just having a negative memory is not necessarily sufficient to our purpose, although it may be. TASOS II also uses positive-negative memory stimuli, such as the store cart in jail—it reminds one of the best part of jail but also of jail.

6. That the subconscious mind is processing more and often subtle information, especially when the senses are heightened such as in a crime/violence/police situation.

Furthermore, that by providing unique, changing, odd, stimuli that is further unusual by it's proximity to other stimuli (e.g. a dog barking followed by glass breaking and a monster voice saying "911 is coming" with a light flashing on each word) requires the mind of a human to stop and absorb this data and process it. "Why are those things together? What does that mean? This is weird . . . I don't know how I feel about this new turn of events . . . "; are some of the thoughts that may go through a perpetrator's mind when confronted with such data. In addition, even normal information such as a countdown from 10 to 1, when modified to change the speed and/or intervals of delivery (e.g. "10" (2 second pause) "9" (2 second pause) "8" (1.5 second pause) "7" (1 second pause) "6" (0.5 second pause) "5") can create a feeling that "something is about to happen" or "events are speeding up" and thus promote the perpetrator's feeling of unease and possibly panic. Modifying the intervals during a simple countdown to alternately increase and then decrease may not create a sense of foreboding but they will cause a normal person to think "That's odd . . . is it broken? . . . why is it doing it like that?"

FIG. 1 is a block diagram of a security network in accordance with an embodiment of the present invention. Referring to FIG. 1, a sensory event controller 114 ("controller") is used to coordinate administration of various stimuli, actions, and responses (collectively, "Sensory Events") across various channels 106 (such as, but not limited to, first responders systems, third-party monitoring services, friends and family networks, a subscriber network, building/home automation networks, vehicle control/security systems, outdoor lighting control systems, municipal control grids for lighting and traffic, safety networks, telecommunication servers, etc.).

Upon receiving a distress signal, the controller 114 determines the how, when, and what type of Sensory Events to initiate in order to distract, delay, disrupt, and/or deter the perpetrator 116. The controller 114 can be a processor, either in the portable device 102 (or any other computing device, including, without limitation, a key fob, smartphone, laptop computer, or a vehicle), or at a remote location, such as a remote monitoring center, or in a third-party computing device. The controller 114 can be communicatively linked to the different channels 106 described above.

The controller 114 can be a human being, such as an operator at a remote monitoring center, a 911 operator, or any third-party human being such as a member of a friends and family network, security network, and neighbors. In this embodiment, the controller 114 is coupled to the portable device 102 via a communication link.

In an embodiment, the controller 114 is located within the portable device 102. The controller 114 can include software and hardware built into the portable device 102. The controller 114 can use data from input sensors on the portable device 102, such as a camera, microphone, accelerometers, temperature detectors, moisture detectors, etc. to determine a state of the user's surrounding environment, and to coordinate any necessary Sensory Events. The controller 114 can also use data from biosensors, such as heart rate monitors, pulse monitors, perspiration monitors, pupil dilation sensors, etc.

In another embodiment, the controller 114 is located at a remote location from the portable device 102. The portable device 102 may transmit signals and data about the user's surrounding environment to the controller 114 via the network 104. The network 104 can include, but is not limited to, wireless networks, short-range protocol networks, and hardwired networks.

In yet another embodiment, the controller 114 can access a perpetrator's profile from various third-party databases, including law enforcement databases, federal government databases, INTERPOL, and court record databases. The controller 114 can also access information regarding the perpetrator's educational background, military service record, and employment history through public and private database sources. The controller 114 can then adjust the Sensory Events based on the perpetrator's profile.

For example, the portable device 102 can capture an image of the perpetrator 116 and perform facial recognition to determine the perpetrator's identity. Alternatively, the user 100 can select a name from their contact list stored in the portable device 102, or the user 100 can select a name or person from a social networking profile that is accessible via the portable device 102 (i.e., selected a name from a Facebook search using the mobile Facebook phone application) to identify the perpetrator 1116.

If the controller 114 determines that the perpetrator 116 is a convicted criminal that has prior military experience, then a heightened response, such as contacting law enforcement, as well as commencing intense Sensory Events, is initiated. On the other hand, if the controller 114 determines that the perpetrator 116 has no known prior criminal history or military experience, and determines that the perpetrator 116 is commonly known to the user (via social network connections, mutual friends, commonly tagged photographs, postings, etc.), or that the perpetrator 116 is a stored contact in the user's portable device 102 and the user 100 has initiated recent calls or text messages to the perpetrator, then a lessened response or a heightened response is initiated by the controller 114. A lessened response may include a light Sensory Events distract, deter, and/or delay the perpetrator 116.

Thus, the controller 114 can determine if the perpetrator 116 is a hardened criminal, sociopath, or an amateur/minimal threat, and deliver an appropriate and effective level of Sensory Events based on the perpetrator's profile.

In addition to the perpetrator's profile, the actual or perceived type of crime, the user's physical environment, and the user's physical and mental condition can be used by the controller 114 to deliver an appropriate and effective level of Sensory Events to initiate.

Figure 2:
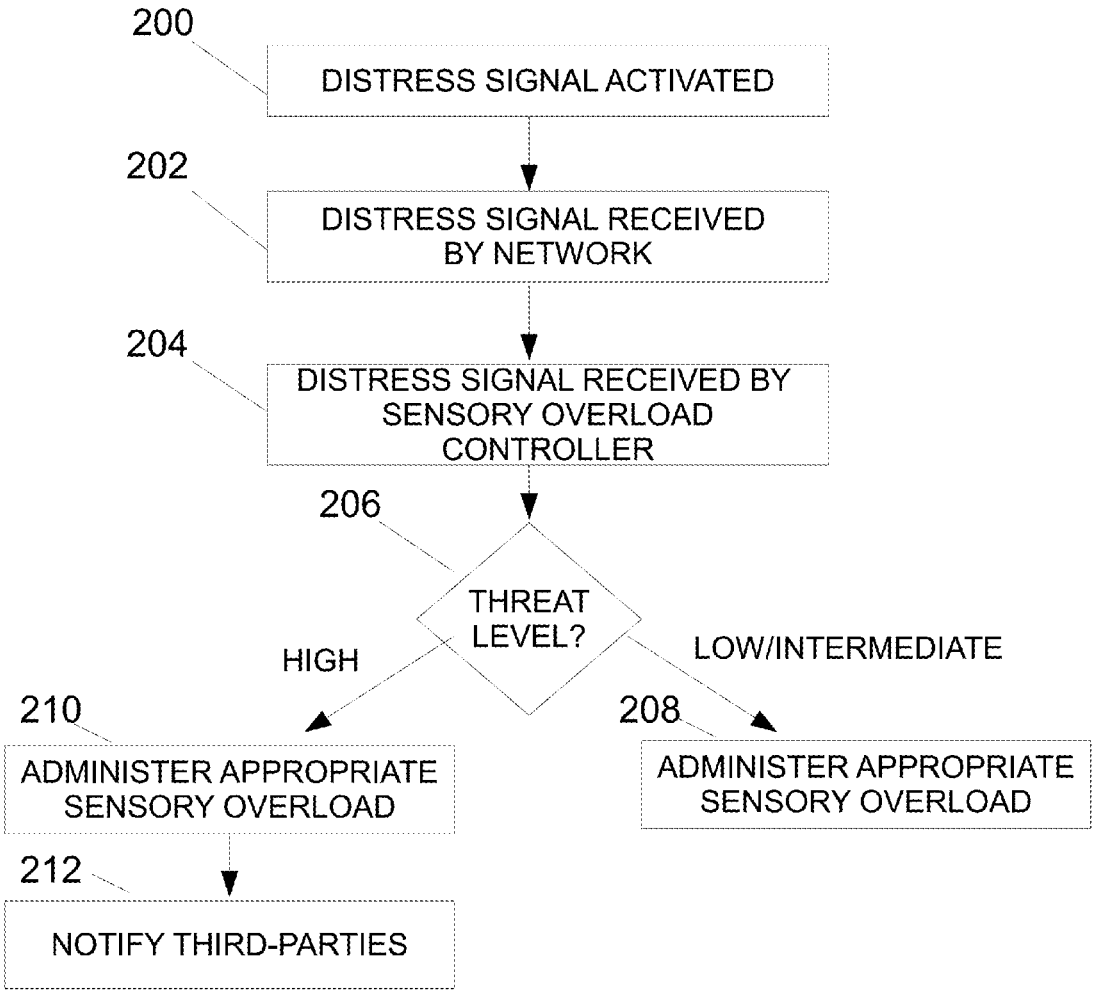
FIG. 2 is a flowchart illustrating the steps of administrating a sensory overload to an environment in accordance with an embodiment of the present invention.

FIG. 2 is a flowchart illustrating the steps of administrating a sensory event to an environment in accordance with an embodiment of the present invention. Referring to FIG. 2, in step 200, a distress signal is activated, either by a user 100 who is feeling unsafe, or feels an imminent threat is about to occur by a perpetrator 116. The perpetrator 116 can be known or unknown. For example, if the user 100 is walking to their vehicle late at night in a deserted parking garage, and has a feeling of apprehension, or hears unusual sounds, the user 100 can activate the distress signal even if they are not sure if an actual perpetrator 116 or threat is nearby. As described below in FIG. 3, the distress signal can be activated by the user 100, automatically by the portable device 102, automatically by a remote channel 106, by actions of the perpetrator 116, or by a third-party, such as an operation center.

By way of a non-limiting example, the distress signal can be activated by one or more of the following:

1) a physical button located on a portable device 102, such as a "Release 911" button;
2) audible sounds and/or voice commands captured by a microphone;
3) a signal from a remote control device (e.g., remote monitoring center, third-party mobile or computing device, etc.);
4) a body movement or gesture of the user 100 or the perpetrator 116 (e.g., hand, finger, facial, eye, and otherwise);
5) input from a computer mouse and/or keyboard;
6) a phone call to a remote monitoring center or a remote third-party;
7) biofeedback; and
8) proximity of another device such as a PSD in the hands of a parolee or known threat.

This disclosure is not limited to any particular activation mechanism. Those of skill in the art will recognize that many other activation embodiments are possible and fully within the scope and spirit of this disclosure.

When the activation means is a virtual or physical button located on a portable device 102 (i.e., a mobile phone, PDA, watch, keychain, etc. as described above), different buttons, inputs, and gestures to the portable device can activate different levels of response as described in co-pending U.S. Non-Provisional patent application Ser. No. 13/159,596, filed on Jun. 14, 2011, the contents of which is hereby incorporated by reference in its entirety. For example, activating via a first button can result in an intermediate response by the controller 114, while activation by a second button can result in a higher level of response by the controller 114.

In another embodiment, the user 100 can request different levels of Sensory Events by using voice commands to activate a distress signal. For example, different code words can be used to indicate various levels of response desired. For example, if the user speaks the word "scared", this could indicate that the user is feeling cautious, and the appropriate Sensory Events are delivered to the user's environment. Furthermore, the volume of the voice command could be used to determine an appropriate response level, such that a softly spoken "scared" could indicate that a potential threat is nearby, and the user cannot speak loudly. Screaming the word "HELP!" could indicate that the user is in immediate danger, and in an even more desperate situation that if they had spoken softly.

Additionally, a microphone can be used to capture the voice command. The microphone can be located on the portable device, or alternatively, it can be built-into the surrounding environment (within walls, ceiling, hidden within objects in a room, automobile compartments, etc.).

In yet another embodiment, the user can call the remote monitoring center and explain their situation/feelings, and the remote monitoring center can assess the situation and provide a Sensory Events that the remote monitoring center deems appropriate. Alternatively, the user 100 can simply request a level of response with the remote monitoring center by stating exactly what Sensory Events they would like administered. The remote monitoring center can then send an appropriate request to the controller 114.

In another embodiment, in addition to the type of Sensory Events that are delivered, the controller 114 can manipulate the method in which these various stimuli, responses, and actions are delivered. For example, the controller 114 can initiate a beeping sound, and ten seconds later, add a human voice to the beeping sound. Fifteen seconds later, an alarm or siren is added to the combination of the beeping sound and human voice. Thus, increasing the types and number of Sensory Events while decreasing the time interval will cause the perpetrator to experience a feeling of urgency and apprehension, and will give them less time to determine why the various Sensory Events are occurring, as each Sensory Event is delivered in a shortened time interval.

The change in tempo of the delivery of Sensory Events can provide psychological confusion to a perpetrator, as an increase in tempo may cause a feeling of imminence to the perpetrator. For example, if a loudspeaker states "Police are en route", and repeats this phrase every 20 seconds, the perpetrator not be affected by a seemingly standard alarm repeated in a constant duration. However, if the phrase "Police are en route" is repeated every 10 seconds for the first minute, and then repeated every 5 seconds the next minute, the perpetrator may feel that the arrival of police is imminent.

In another embodiment, the phrase can be changed over time, and with increasing tempo, so that initially the alarm states "Police are en route", and then "Police are 30 seconds away", and finally, "Police have arrived on location".

The time interval for the tempo change can be based on pre-set or pre-determined settings at the controller 114 or it can be randomized. In another embodiment, the time interval for the tempo change can be based on feedback received by the controller 114 from the network and/or electronic appliances coupled to the network.

The controller 114 can manipulate multiple aspects of delivering the Sensory Events. For example, the controller 114 can initiate multiple Sensory Events simultaneously, in an alternating fashion, and/or can have different Sensory Events independently occur in different time intervals (i.e., every five seconds), can adjust the rate of change of each Sensory Event relative to another (i.e., a shorter or longer time interval), and can change the intensity of the Sensory Events (sound volume, brightness level, flicker level, repetition frequency, etc.).

Next, in step 202, the distress signal is received by the network 104, and the network 104 routes the distress signal to the controller 114. In an embodiment, the network 104 can append the distress signal with location coordinates, timing, and other information (if the distress signal was not provided such information by the portable device 102). In another embodiment, the distress signal can be directly transmitted to the controller 114, for example, directly from the portable device 102 to the controller 114, without requiring the network 104.

In step 204, the distress signal is received by the controller 114 from the network 104 or the portable device 102. The controller 114 decodes the distress signal and extracts information such as the user's location, time of day, temperature at user's location, weather conditions at user's location, the user's velocity, user's programmed inputs, a distress signal level, etc. In step 206, the controller 114 then inputs this decoded information into the algorithm as described in as described in co-pending U.S. Non-Provisional patent application Ser. No. 12/862,117, filed on Aug. 24, 2010, to determine a perceived threat level.

In yet another embodiment, the user can select a response level via the portable device 102 when they activate the distress signal as described above, so that the controller 114 does not need to calculate the level of response. For example, a lower response level may include a blinking red light on the portable device 102, or a prompt for the user to check in with a third-party by inputting a text or voice code into the portable device 102. A higher response level may include activating a loudspeaker and playing a pre-recorded message to the surrounding environment.

If in step 206, if the controller 114 determines that the perceived threat level is low or intermediate, this may, for example, indicate that the user is apprehensive and feels a potential threat, is scared or is nervous, however, the situation has not escalated to the point of an actual perceived threat, violence, or otherwise dangerous situation. The user can simply feel that there may be an up-coming or impending threat, i.e., having a "gut feeling". In step 208, the controller 114 then calculates the appropriate Sensory Events to administer based on the perceived threat level. The controller 114 can activate any or all of the following non-limiting exemplary Sensory Events:

(1) Turning on lights in a dark environment.

(2) Blinking lights in the environment.

(3) Playing a pre-recorded message (such as a dog barking, a window breaking, a vehicle approaching, a police officer's voice, or another voice or voices).

(4) Turning on appliances.

(5) Opening/closing doors and windows.

(6) Opening/closing blinds.

(7) Ringing the doorbell and/or home phone.

(8) Flashing street lights.

(9) Activating car alarms.

(10) Activating home alarm systems (including, but not limited to, fire, smoke, carbon-monoxide detection systems).

Each of the above Sensory Events, or any combination therein, can be activated specifically to disturb a perpetrator's thinking process. This combination of seemingly random events serves to confuse and overwhelm a perpetrator, which can deter, delay, and distract the perpetrator in hopes of disrupting or decreasing the intensity of a potential criminal act. These events can also be clearly orchestrated and/or intentionally confusing, such as with mumbling references.

If in step 206, the controller 114 determines that the perceived threat level is high, this indicates that a threatening situation is imminent. The user 100 may have already identified the perpetrator 116, and has to react quickly in order to prevent harm to themselves or to their property. The situation may have escalated to the point where the user would call 911, but in this case, a more immediate response is required in order to prevent harm from occurring. In step 210, the controller 114 determines the appropriate Sensory Events to be administered to distract, delay, and/or deter a perpetrator, or to disrupt or decrease the intensity of a crime or violent act. In addition, the controller 114 can transmit the distress signal to various channels 106, such as first responders, private monitoring/security providers, the user's personal friends/family network and/or security networks. Using the information from the distress signal and a computed threat level, the controller 114 can activate any or all of the following non-limiting exemplary Sensory Events:

(1) Notifying a pre-determined list of persons that the user 100 may be in danger.

(2) Broadcasting a real-time, live audio or video message from a remote monitoring center operator or law enforcement official to the portable device 102 as well as to any televisions or computers in the vicinity of the user.

(3) Alerting a remote monitoring center, such as a 911 response center.

(4) Locking doors or blocking exit ways.

(5) Activating fire sprinkler systems.

(6) Emitting a chemical from the user's device.

(7) Activating video/audio recording devices.

In another embodiment, if the perpetrator 116 is someone known to the user 100, the user 100 can select the perpetrator's name from their contact list. The controller 114 can use third-party databases, such as, for example, the remote monitoring center's information database, government agency databases, military and intelligence database, third-party home and office security provider systems, and law enforcement databases, to determine personal information about the perpetrator. The personal information may include names of the perpetrator's family members (parents, spouses, children, siblings, grandparents, etc.), home address, employer, birth date, etc. The controller 114 can access the user's social networking profiles, such as Facebook and MySpace, and scan the perpetrators profile for personal information as well, such as hometown, high school, college, favorite movies, artists, etc.

In another embodiment, the portable device 102 can continuously or intermittently update its local memory with information from these above-mentioned databases. In the event that the user 100 is in an environment without cellular reception or is unable to obtain a communication link to the network 104, the controller 114 can utilize information in the local memory 114 to deliver Sensory Events. The updates can be made, hourly, daily, weekly, etc., or on-demand by the user 100 or third-party that has access to the portable device 102.

In yet another embodiment, the portable device 102 can sync with another device (portable device, tablet, desktop computer, laptop computer, etc.). For example, many business people carry two communications devices, one for personal use, and one for business use. Thus, the multiple devices can continuously or intermittently sync with each other so that regardless of which device the user 100 has access to upon encountering a perpetrator 116, the user 100 will have complete access to the systems and methods described herein.

Using the gathered personal information about the perpetrator 116, the controller 114 can emit in a random sequence and at random or pre-determined intervals information about the perpetrator. For example, the portable device 102 can emit the perpetrator's birth date, and then ten seconds later, it can emit the first name of the perpetrator's spouse or child. Ten second later, the portable device 102 can emit the name of the perpetrator's employer.

Upon hearing this personal information, as well as being overwhelmed by other visual and auditory responses that may be occurring simultaneously, the perpetrator will be confused and overwhelmed. In addition, all of these Sensory Events take up mental processing time that the perpetrator would otherwise use to complete a crime of other action.

Figure 3:
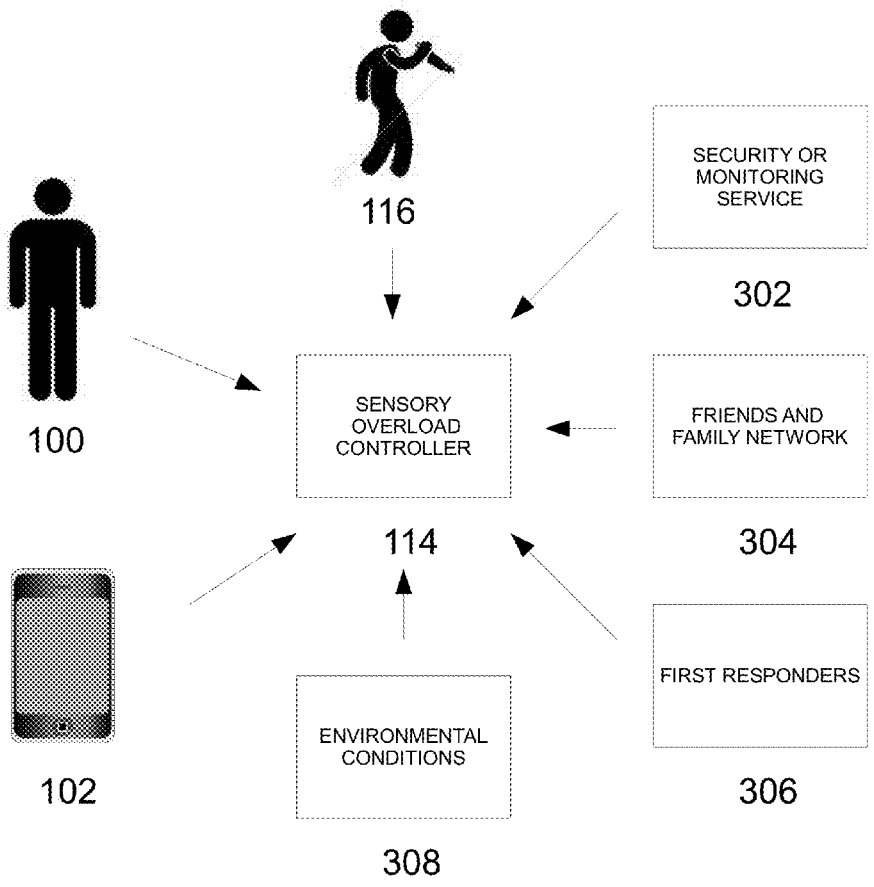
FIG. 3 is a block diagram of the different channels by which a distress signal can be activated in accordance with an embodiment of the present invention.

FIG. 3 is a block diagram of the different channels by which a distress signal can be activated in accordance with an embodiment of the present invention. The distress signal can be activated by the user 100, automatically by the portable device 102, automatically by a remote channel 106, by actions of the perpetrator 116, or by a third-party, such as a security or monitoring service 302 (i.e., private security monitoring center, 911 call center, etc.), users/devices on a friends and family network, and/or first responders 306.

For example, the deter signal may also be activated by a parent who is remotely monitoring their child. In response to the deter signal, the controller 114 can initiate Sensory Events to the child's location/environment to deter, distract, and/or delay the perpetrator 116.

In another embodiment, the deter signal may be activated if a perpetrator 116 attempts to grab the portable device 102 from the user 100. Sudden movements, falling, crashing into a surface, etc. can be sensed by accelerometers, gyroscopes, and tiltmeters built into the portable device 102. Any such movements can trigger the controller 114 to initiate a response.

Furthermore, the distress signal can be activated by the conditions in the user's surrounding environment 308, such as, for example, lighting, temperature, auditory signals (gun shots, screaming, etc.), visual signals (flashing lights, flickering lights, etc.). Regardless of how the distress signal is activated, the end goal is the same, to disturb a perpetrator's thinking process so that a threatening situation can be deterred, delayed, lessened, or prevented.

The distress signal can be manually initiated by the user 100 by manipulating the portable device 102, or alternatively, communicated with a remote third-party such as the monitoring service 302 via another method (another cellular or landline phone, text message, email, social media posting, etc.).

In another embodiment, the distress signal can be activated by sensors specifically tuned to recognize extreme stress consistent with a physiological or chemical reaction to a situation, or to recognize a medical crisis, such as, for example, low blood sugar, heart arrhythmias, los oxygen saturation, or no pulse. This embodiment requires the portable device 102 to be equipped with the appropriate body sensors to be coupled to the user 100.

While not intended to be limiting, below are various exemplary environments and situations where the present invention can be utilized.

Personal Security Scenario

Consider the scenario where a single woman is walking home alone from a bar. The route she is taking is off the beaten path. The woman senses that she is being followed by someone she met in the bar. She has limited options at this point; she can run and hope that she is faster than the perpetrator, or she can call 911 and hope that they arrive before she is attacked, she can fight back, or worse. The present invention provides a third option, deterring, delaying and distracting the perpetrator or disrupting or decreasing the intensity of the criminal act. In addition, the present invention can calm down a perpetrator, or deplete their anger level if a perpetrator is acting in the heat of passion.

In this scenario, the woman can activate a distress signal, using one of the methods described above. In response, the controller 114 receives the woman's exact location, time of day, her movement velocity and path, etc. and then initiates a TASOS II response. For example, the controller 114 activates a blinking light on the portable device 102, emits a pre-recorded message from the portable device 102 stating "911 is responding", and automatically activates the woman's car alarm. This is a level I example and not limiting but it shows a very basic TASOS II response, which would serve to distract, deter or delay the perpetrator or alternately to disrupt or decrease the crime. Thus, while the perpetrator is warned that assistance is on the way, his thought process may be disrupted due to the blinking light and wondering how the car alarm could be activated as well.

In addition, the controller 114 can determine if any members/volunteers of a safety network (i.e., Spartans, as described in co-pending U.S. Non-Provisional patent application Ser. No. 12/862,117, filed on Aug. 24, 2010) are in the vicinity of the woman's home, and if so, notifies them as well. Thus, the Spartans may be able to reach the woman's location and provide assistance/crowding before first responders arrive.

The controller 114 can address two kinds of perpetrators; someone who is currently threatening the user 100, and someone who may be a threat in the near future, but who is currently unknown or unidentified by the user (i.e., someone hiding in the bushes near the user's car or home).

Consider the above scenario, but instead, the woman did not meet anyone particular at the bar. However, while walking home, she gets a feeling that someone may be following her. She can activate a distress signal, and the controller 114 can emit a pre-recorded message from the portable device 102 stating "Release 911 activated!", and repeat this message at pre-determined intervals (i.e., 10 seconds, 20 seconds, etc.). In addition, the portable device 102 can activate a blinking light, flicker its camera flash, emit sounds of cameras taking pictures, emit music, can vibrate or provide tactile sensations, can emit a high level of heat so that it is hot to the touch, or emit other pre-recorded messages at pre-determined intervals (i.e., 2 seconds, 5 seconds, etc.). Having multiple events occurring (music, lights, flash, recorded messages, etc.) will have a similar effect as described above for a known perpetrator.

In yet another embodiment, the portable device 102 can record the perpetrator's voice and statements, and can play these back in a re-arranged format. For example, if the perpetrator states "Give me your money!", the controller 114 can re-arrange these words and emit back to the perpetrator "Money! your me give."

In an embodiment, when a human voice is emitted from a speaker of the portable device 102, or any other speaker that is communicatively coupled to the controller 114, the controller 114 can jumble or mumble the words so that only a portion of the information is understandable or decipherable by the perpetrator 116. This would give the perpetrator 116 just enough information about what is happening or is about to happen, however, the perpetrator 116 now needs to think about if what they deciphered is really what they heard.

In yet another embodiment, the controller 114 can re-arrange the words in a sentence, or omit words from a sentence so that only a portion of the information is understandable or decipherable by the perpetrator 116.

In addition, the controller 114 patches in a remote monitoring center operator, who can announce through a microphone on the woman's portable device that help is on the way, and that the authorities have been notified.

If the woman is near her vehicle, the controller 114 can activate the horn and/or lights on her vehicle, as well as any other vehicles in the vicinity that are part of the network 104. In addition, the controller 114 can automatically start her vehicle and unlock the doors so that she can quickly enter the vehicle and drive away, instead of fumbling for keys.

If the woman is near a building that is part of the network, the controller 114 can activate a non-emergency siren in the building, similar to a fire or burglary alarm.

In another embodiment, upon command from a remote monitoring center, the woman can abandon her device or throw it at the perpetrator 116. The controller 114 can then cause the phone to explode, startling and dazing the perpetrator 116. In this embodiment, the device is fitted with a miniature explosive device that can be triggered remotely by the controller 114.

Thus, with all of these external sensory events occurring, from various sirens, lights, horns, and audible communication from the woman's device, the potential perpetrator 116 may be more likely to retreat, rather than engage the woman.

The controller 114 can also be communicatively coupled to a municipal lighting grid. In an embodiment, the controller 114 can determine the woman's fastest and safest path to a safe location (i.e., restaurant, police station, public/crowded place, etc.), and can selectively light lampposts that will lead the woman along this path.

Furthermore, the controller 114 can be communicatively coupled to a municipal video monitoring network, and can selectively activate or control video cameras that are in the woman's vicinity so that the remote monitoring center can visually track and record the woman's movements.

In yet another embodiment, the controller 114 can automatically dial all of the phone numbers in the woman's device, and/or all of the recently dialed numbers and incoming calls. In another embodiment, the controller 114 can call recently added numbers in the device. These embodiments allow for the remote monitoring center to reach out to anyone that the woman has recently met, or recently contacted, in the event that the perpetrator is someone that the woman knows. Consider the scenario when a woman meets someone at a bar, and exchanges numbers. This person could possibly be a perpetrator.

Home Security Scenario

Within a household setting, the controller 114 can be connected, either through hard wires or a wireless connection as described above, to the home's indoor and outdoor lighting, appliance, ventilation, heating/cooling, window, blinds/shades, and door control systems.

Consider a nighttime scenario, where a woman is alone at home, upstairs in bed. She thinks she hears noise downstairs, but is not sure, and certainly does not want to call 911 at this point. The woman can activate a distress signal, using one of the methods described above. The controller 114 receives the distress signal via the network 104, and using the computed perceived threat level described above, determines that the woman is in her home, and that the signal was activated at a time of night when the women is typically sleeping. The controller 114 can also receive information from the home security system to determine if any window/doors are open or broken. The controller 114 then proceeds with activating a pre-recorded message can be played on the home speaker system, such as a man's voice stating "Honey, I'm home!", a dog barking, children's voices, etc.

In addition, simultaneous to the pre-recorded message, the downstairs lights can turn on. The lights in all of the rooms can turn on all at once, or they can be turned on in a pre-determined or random order. The lights can also turn on, and then off, repeatedly, in a pre-determined or random order.

The controller 114 can repeatedly call the landline in the home, and provide a pre-recorded or live message in the event a perpetrator decides to pick up.

Along with lights, various household appliances, such as televisions, radios, alarm clocks, microwaves, dishwashers, coffee makers, and computers can be powered-on or activated.

Additionally, the garage door can open/close at the same time, as well as other doors in the house that are motorized and connected to the security system (i.e., pantry, porch, front, closet, bathroom, etc. doors).

As can be seen, each of the above examples can be used in combination with one another to disturb a perpetrator's thought process, thereby deterring, delaying, and distracting the perpetrator, and disrupting or decreasing the intensity of a potential criminal act. The sensory overload controller 704 uses devices and systems that normally do not correlate with each other (i.e., flickering lights, a microwave, and a doorbell) which, when activated repeatedly and simultaneously, would overwhelm the perpetrator's thought process.

Furthermore, the controller 114 can also activate all recording devices in the home, such as computers/laptops with a video camera, security cameras, and devices with audio recording capabilities (i.e., smart phones, PDAs, etc.). The user can link the controller 114 (or a local hub to the controller, such as a home server, if the controller 114 is at a remote location) to various devices in the home via a wireless pairing connection, such as, for example, Bluetooth or Zigbee.

In another embodiment, the portable device 102 can create a short-range virtual network, such as a ghost network, such that any surrounding device within a radius of the portable device 102 can be alerted if the user 100 is in distress. If a surrounding device is part of a security network, or is authorized to be a host communicator, that device can receive a distress signal via the virtual network, and can communicate with third-parties on behalf of the portable device 102 if the portable device 102 does not have access to the network 104.

Furthermore, upon receiving such a distress signal via the virtual network, the owners of these surrounding devices may be provided location information about the user 100 and/or the portable device 102, so that they can crowd the scene and provide assistance before any first responders arrive.

In yet another embodiment, after the portable device 102 connects with another surrounding device or devices via a virtual network, short-range protocol, or wireless or hard-wire connection of any type, the surrounding devices can capture information of the environment and/or perpetrator 116 by taking photographs, videos, audio recording, location information, temperature information, etc. This information can later be retrieved by law enforcement and other agencies for crime scene analysis and forensics evaluation. The owners of the surrounding devices may opt-in to a security network to automatically capture such information and provide it as needed to various agencies upon request.

This allows the user to determine activity in a first location of their home, while they physically are in a second, remote location of their home. In the present scenario, a phone located downstairs can be activated so that the woman and/or remote monitoring center can listen through the downstairs phone and determine if any noise/movement is occurring.

In an embodiment, the controller 114 can control various functions on other devices that are paired with the controller 114, such as calling 911 from a phone (other than the user's device), or activating the strobe features, music player, volume, video capture, etc. on another phone.

This pattern of administering Sensory Events can continue until the situation has been assessed and deemed safe by the user or a third-party (i.e., law enforcement, first responder, private security service, neighbor, etc.).

As can be seen, if there was a perpetrator inside (or outside) of the house believing that either no one is home, or that the homeowners are asleep, the perpetrator may choose to retreat, as the Sensory Deterrents makes it appear that there is a presence in the home. Furthermore, in this scenario, the woman can more assuredly go downstairs after the Sensory Deterrents have been delivered, as her mind is more at ease that any potential threat has been scared away.

Now, consider again the above scenario, where a woman is alone at home, upstairs in bed. She sees a shadow walking in the hallway. She is fairly certain that a perpetrator is in her home. She activates a distress signal, using one of the methods described above, and specifies that she requires an escalated response. The controller 114 then activates a Overload similar to the ones describes above, but the controller 114 also automatically notifies a remote monitoring center with the user's location and a request that law enforcement or security officers come to the user's assistance.

The controller 114 can also notify neighbors that the user may be in distress. The neighbors can receive a phone call, text message, and/or an email from the remote monitoring center. The controller 114 can also determine if any members/volunteers of a safety network (i.e., Spartans) are in the vicinity of the woman's home, and if so, notifies them as well. Thus, the Spartans may be able to reach the woman's home and provide assistance/crowding before first responders arrive.

In addition, the controller 114 can automatically close all of the doors and windows in the home and lock them, effectively trapping a perpetrator 116 if they happen to be in a room without any other exit.

In addition, a distress message is automatically transmitted to a pre-determined group of contacts, such as friends, family members, co-workers, etc, and a distress message can be posted on the user's social messaging account, such as Facebook, Orkut, Twitter, LinkedIn, and/or Google+.

Vehicle Safety Scenario

The present invention is not limited to personal and home safety, and it can be used for vehicle theft deterrent systems as well. In an embodiment, a sensor is mounted on a vehicle, such as an automobile. The sensor can be a vibration sensor, ignition lock sensor, radio mount sensor, glass break sensor, and/or a proximity detector. Upon sensing a possible attempt to break into the vehicle, attempt to manipulate the ignition switch, attempt to remove tires, attempt to siphon gasoline, and/or steal interior components such as an airbag or stereo, a distress signal is transmitted to the controller 114 from an on-board processor coupled to the sensor.

The controller 114 decodes information from the distress signal, such as time of day, type of vehicle, location, etc. Along with information from a third-party database, such as automobile theft statistics from a given location, recent automobile thefts, etc. The Algorithm then determines a perceived threat level. The controller 114 calculates the appropriate response level that is required to address the perceived threat level.

In an embodiment, the controller 114 can determine if any other vehicles in the vicinity are part of the network 104. If so, the controller 114 can activate the horns and/or lights of any nearby automobiles.

The controller 114 can also determine if any members/volunteers of a safety network (i.e., Spartans) are in the vicinity of the automobile, and if so, notifies them as well. Thus, the Spartans may be able to reach the automobile and provide assistance/crowding before first responders arrive.

The controller 114 can activate any on-board video cameras, such as a rear-view camera, and capture and record any images from the rear of the vehicle.

The controller 114 can activate an ignition kill-switch, which prevents the vehicle from starting, either with a key or through "hot-wiring" the ignition cables, thus, leaving the vehicle immovable.

Additionally, the controller 114 can turn on the car stereo system at a high decibel level.

In another embodiment, the controller 114 can place a call to the vehicle's owner, and patch the owner through to the vehicle's speaker system, allowing the owner to warn or dissuade any potential perpetrators. Similarly, a remote monitoring center operator or law enforcement official can speak directly to the perpetrator through the vehicle's speaker system.

Missing/Abducted Child Scenario

Consider the scenario where a group of children or teens are on an outing, such as to a sporting event, concert, or a shopping mall. In an embodiment, a parent can notify the remote monitoring center 108 that the group of children is participating in this outing. The remote monitoring center 108 then registers each child's portable device, and continuously or intermittently monitors the location of each device. If any of the devices stray from the group more than a pre-determined amount, i.e., 500 feet from the rest of the group, the controller 114 can place a call and/or send a text message to each of the children's devices, requesting confirmation that the stray child is accounted for, or is safe. In an embodiment, the controller 114 can send a MMS with the stray child's photograph to the group.

If the remote monitoring center does not receive confirmation from the group that the stray child is accounted for, the controller 114 can escalate the situation, and connect the remote monitoring center 108 to the local security personnel at the location of the event. The local personnel can them immediately transmit a message and/or broadcast a photograph of the stray child over a large screen or loudspeaker. This is similar to an "Amber Alert"; however, this message broadcast occurs within minutes after a possible abduction, thus, increasing the chances of capturing the perpetrator and locating the missing child.

In addition to messaging the group, the controller 114 can notify all of the respective parents of the children in the group by any of the methods described above.

The controller 114 determines if any members/volunteers of a safety network (i.e., Spartans) are in the vicinity of the group, and if so, notifies them as well. Thus, the Spartans may be able to locate the stray child and provide assistance/crowding before first responders arrive.

The above embodiments are not limiting, and the systems, responses, and methods described above can be applied to building alarm systems, business alarm systems, perimeter defense systems, military and combat systems, defense systems, surveillance systems, law enforcement/SWAT/hostage negotiation team intelligence and action systems, airplane/cockpit defense systems, and any situation where personal and/or property safety may be endangered by a perpetrator.

While the principles of the disclosure have been illustrated in relation to the exemplary embodiments shown herein, the principles of the disclosure are not limited thereto and include any modification, variation or permutation thereof.

What is claimed is:

1. A system for manipulating delivery of sensory events, the system comprising:

a security controller configured to emit a control signal in response to a distress signal provided by one of a user and a remote monitoring center; and an electronic appliance wirelessly coupled to the security controller, and configured to receive the control signal from the security controller and, in response, to deliver sensory events at a tempo set by the control signal, wherein the security controller is configured to adjust the tempo of the delivery of the sensory events, the tempo change based on feedback received from the electronic appliance.

2. The system of claim 1, wherein the security controller and the electronic appliance are coupled via a wireless network.

3. The system of claim 1, wherein the security controller is located remotely from the electronic appliance.

4. The system of claim 1, further comprising a second electronic appliance coupled to the security controller, the second electronic appliance configured to activate or deactivate upon receipt of the control signal.

5. The system of claim 1, wherein the electronic appliance is selected from a group consisting of an illumination device, a speaker, a household appliance, a television, a radio, an alarm clock, a window lock, a door lock, a garage door opener, an air conditioning system, an automobile, a cellular phone, a computer, a landline telephone, an alarm system, and a stereo system.

6. The system of claim 1, wherein the security controller is configured to adjust the tempo of the delivery of the sensory events in a pre-determined manner.

7. The system of claim 1, wherein the security controller is configured to adjust the tempo of the delivery of the sensory events in a random manner.

8. The system of claim 1, wherein the security controller is configured to adjust the time intervals between the deliveries of the sensory events based on feedback received from the electronic appliance.

* * * * *